US007537724B2

(12) United States Patent
Stastny et al.

(10) Patent No.: US 7,537,724 B2
(45) Date of Patent: May 26, 2009

(54) COOLING PLATE FOR METALLURGIC FURNACES

(75) Inventors: Wilhelm Stastny, Alberndorf (AT); Herbert Scharinger, Leonding (AT); Walter Rainer Kastner, Zwettl/Rodl (AT)

(73) Assignee: Siemens Vai Metals Technologies GmbH & Co. (AT)

( * ) Notice: Subject to any disclaimer, the term of this patent is extended or adjusted under 35 U.S.C. 154(b) by 236 days.

(21) Appl. No.: 10/525,600

(22) PCT Filed: Jul. 14, 2003

(86) PCT No.: PCT/EP03/07580

§ 371 (c)(1),
(2), (4) Date: Feb. 22, 2005

(87) PCT Pub. No.: WO2004/018713

PCT Pub. Date: Mar. 4, 2004

(65) Prior Publication Data

US 2005/0218569 A1 Oct. 6, 2005

(30) Foreign Application Priority Data

Aug. 20, 2002 (EP) ..... 02018642

(51) Int. Cl.
*C21B 7/10* (2006.01)

(52) U.S. Cl. ..... 266/193; 266/194

(58) Field of Classification Search ..... 266/193, 266/194

See application file for complete search history.

(56) References Cited

U.S. PATENT DOCUMENTS 4,397,450 A * 8/1983 Kammerling et al. ..... 266/193

(Continued)

FOREIGN PATENT DOCUMENTS

DE 3100321 C1 1/1981

(Continued)

OTHER PUBLICATIONS

International Search Report dated Sep. 16, 2003.

(Continued)

*Primary Examiner*—Kevin P Kerns
(74) *Attorney, Agent, or Firm*—Ostrolenk, Faber, Gerb & Soffen, LLP

(57) ABSTRACT

The invention relates to a cooling plate made of copper or a low-alloy copper alloy for metallurgic furnaces provided with high-strength sheet steel on the outside of the furnace. Said cooling plate has at least one, preferably at least two, coolant channels which extend inside the cooling plate, whereby coolant tube pieces used for feeding the coolant and discharging said coolant extend through the high-strength sheet steel of the furnace and are guided in an outer direction. Retaining tubes are arranged on the cooling plate and are provided with retaining disks which are arranged outside the high-strength sheet steel of the furnace and which fix the cooling plate in the direction of the inside of the furnace. The retaining tubes and retaining disks are preferably made of steel.

25 Claims, 9 Drawing Sheets

U.S. PATENT DOCUMENTS

| | | | | | |
|---|---|---|---|---|---|
| 5,676,908 | A | * | 10/1997 | Kubbutat et al. | 266/193 |
| 5,904,893 | A | * | 5/1999 | Stein | 266/46 |
| 6,126,893 | A | * | 10/2000 | Otsuka et al. | 266/193 |
| 6,132,673 | A | * | 10/2000 | Hille et al. | 266/193 |
| 6,470,958 | B1 | * | 10/2002 | Solvi et al. | 164/465 |
| 6,660,222 | B1 | * | 12/2003 | Heinrich et al. | 266/193 |
| 6,843,958 | B1 | * | 1/2005 | Korbik et al. | 266/194 |
| 2004/0046292 | A1 | * | 3/2004 | Heinrich | 266/194 |
| 2004/0129187 | A1 | * | 7/2004 | Korbik et al. | 110/180 |
| 2005/0218569 | A1 | * | 10/2005 | Stastny et al. | 266/193 |

FOREIGN PATENT DOCUMENTS

| | | | | |
|---|---|---|---|---|
| DE | 39 25 280 | | | 2/1991 |
| DE | 198 01 425 | C2 | | 7/1999 |
| DE | 199 43 287 | A1 | | 3/2001 |
| DE | 100 49 707 | A1 | | 4/2002 |
| EP | 0 052 039 | | | 5/1982 |
| EP | 0 144 578 | | | 6/1985 |
| EP | 0 705 906 | A1 | | 4/1996 |
| EP | 0 731 180 | B1 | | 9/1996 |
| EP | 1 077 358 | A1 | | 2/2001 |
| FR | 2 564 484 | | | 11/1985 |
| GB | 2 131 137 | A | | 6/1984 |
| JP | 8-225813 | A | | 9/1996 |
| JP | 10-219320 | | | 8/1998 |
| JP | 11-286708 | | | 10/1999 |
| JP | 2002-60818 | | | 2/2002 |
| PL | 104515 | | * | 10/1997 |
| PL | U104515 | | | 10/1997 |
| WO | WO 02/35168 | A1 | | 5/2002 |

OTHER PUBLICATIONS

German Search Report dated Mar. 28, 2003.

Heinrich, P., et al., "Blast Furnace Jacket Cooling—Construction Design and Costs of Cooling Systems", *Stahl und Eisen*, 106(5):205-210 (1986). (in German).

English translation of Heinrich, P., et al., "Blast Furnance Jacket Cooling—Construction Design and Costs of Cooling Systems", *Stahl und Eisen*, 106(5):205-210 (1986).

* cited by examiner

COOLING PLATE FOR METALLURGIC FURNACES

CROSS REFERENCE TO RELATED APPLICATIONS

The present application is a 35 U.S.C. § 371 national phase conversion of International Application No. PCT/EP2003/007580 filed 14 Jul. 2003, which claims priority from European patent application No. 02018642.5, filed Aug. 20, 2002 and published in the German language.

FIELD OF THE INVENTION

The invention relates to a cooling plate, consisting of copper or low-alloy copper alloy, for metallurgical furnaces provided with an outer furnace casing plate, having at least one, preferably at least two, coolant passages which run inside the cooling plate, coolant pipe sections for coolant to flow in and out being led to the outside through the furnace casing plate.

Cooling plates of this type are arranged between the shell and the lining and are connected to a cooling system. On the side facing the interior of the furnace, the cooling plates are in part provided with refractory material.

BACKGROUND OF THE INVENTION

DE 39 25 280 has disclosed a cooling plate in which the cooling passages are formed by pipes cast into cast iron. The bearing lug is also connected to the cooling system. The dissipation of heat from these plates is low on account of the low thermal conductivity of the cast iron and on account of the resistance between the cooling pipes and the plate body caused by a layer of oxide or an air gap.

In the event of a loss of the blast furnace refractory lining after a certain operating time, the inner surface of the cooling plates is directly exposed to the temperature of the furnace. Since the furnace temperature is well above the melting point of cast iron and the inner heat transfer resistances of the cooling plates lead to unsatisfactory cooling of the hot side of the plates, accelerated wear of the cast iron plates is inevitable and the service life is correspondingly limited.

DE 199 43 287 A1 has disclosed a copper cooling plate which, in the vicinity of the upper coolant pipe sections, is fixedly connected to the furnace casing by means of a fixed-point securing element. In addition, the upper coolant pipe sections are likewise fixedly connected to the furnace casing. Further securing elements are designed as movable-point securing elements which allow mobility in both the horizontal direction (x) and in the vertical direction (y). The lower coolant pipe sections are connected in a gastight manner to the furnace casing only by means of standard compensators. Therefore, in this region the cooling plate is not fixed in any of the three spatial directions.

On account of the fact that the side of the cooling plate which faces the interior of the furnace reaches temperatures of more than 300° C. and the side which faces the furnace casing remains at coolant temperature, i.e. approximately ambient temperature, the cooling plate is exposed to very high thermally induced stress forces. In the cooling plate described in DE 199 43 287 A1 this means that the plate, which is of course completely fixed at a number of locations, is plastically deformed under the influence of heat and during cooling bulges into the interior of the furnace in the shape of a dish. This leads to cracks in the coolant pipe sections and to coolant leaks.

SUMMARY OF THE INVENTION

In view of the prior art, the invention is based on the object of providing a cooling plate in which dish-shaped deformation of this type is no longer possible and in which, therefore, stress-induced cracks no longer occur in the coolant pipe sections.

According to the invention, this object is achieved through the fact that the cooling plate is provided with holding pipes which are led to the outside through the furnace casing plate and which, after they have been passed through the furnace casing plate, are provided with securing elements, in particular holding plates or holding disks, and the holding pipes and the securing elements being made from a material which has an increased strength compared to copper or low-alloy copper alloy.

The cooling plate according to the invention is movable in both the vertical direction (y) and the horizontal direction (x) at the positions of the holding pipes, whereas a movement in the z direction, i.e. "dishing" in the direction of the interior of the furnace, is prevented by the securing elements which are arranged at the holding pipes and are supported against the furnace casing outside the latter.

Unlike in the prior art, any stresses which nevertheless occur in the z direction, are not borne by the copper coolant pipe sections, which are not suitable for this purpose, but rather by the holding pipes and securing elements, which are made from a much more suitable material.

The material which is specifically preferred for the holding pipes and securing elements is steel, possibly even special steel. However, in principle any material is suitable, provided that it satisfies the requirement of having a significantly higher strength than copper or low-alloy copper alloy, as is the case with steel. A material which can be welded at least to itself and preferably also to copper or low-alloy copper alloy, as is likewise the case with the particularly preferred material steel, is also preferred.

According to an advantageous embodiment, the cooling plate according to the invention is connected to the furnace casing plate in a central region by means of a fixed-point securing element.

A fixed-point securing element of this type may, for example, be a securing bolt and at this location fixes the plate in each of the three spatial directions.

In this way, the cooling plate according to the invention is fixed in position and cannot be moved out of this position in any way by thermally induced stress forces. On the other hand, thermal expansion of the plate remains unrestricted from this central fixed point.

According to a further advantageous embodiment, the cooling plate—in particular with a cooling plate height/width ratio of $\geqq 3$—is provided with at least one movable-point securing element which is arranged above and/or below the fixed-point securing element and allows mobility only in the vertical direction.

Alternatively, the cooling plate—in particular with a cooling plate height/width ratio of $<3$, preferably $<2$—is provided with at least one moveable-point securing element which is arranged to the left and/or to the right of the fixed-point securing element and allows mobility only in the horizontal direction.

A movable-point securing element of this type may, for example, be a securing bolt with disk, the disk remaining unwelded to the furnace casing plate and being able to slide in a guide in one direction, and the movable-point securing element, depending on its orientation, fixes the plate either in the x direction or in the y direction and at any rate in the z direction.

In addition to the fixing achieved by the central fixed point, both the variants described ensure that the cooling plate is not simply completely fixed in position, but rather that the cooling plate is also prevented from twisting as a result of thermally induced stress forces. Furthermore, thermal expansion of the plate in the directions allowed by the movable-point securing elements is freely possible.

A particularly preferred embodiment of the cooling plate according to the invention consists in the cooling plate having tongues and grooves on the side which faces the interior of the furnace, the tongues being segmented in their longitudinal direction.

The tongues are the part of the cooling plate which is least exposed to the cooling action of the coolant. Consequently, the tongues are the part of the cooling plate as a whole which reaches the highest temperature (the temperature of approximately 300° C. mentioned in the introduction). Dividing the tongues into individual sections reduces the stress forces caused by the thermal expansion of the tongues to the minimum possible. Subdividing the tongues alone would in cooling plates known from the prior art be a suitable way of reducing the "dishing" of the cooling plates and increasing the service life of the cooling plates, in particular the coolant pipe sections.

In order not to adversely affect the mechanical strength of the cooling plate as a whole, it is in this context preferable for the segmenting of the tongues to be implemented as incisions arranged substantially at right angles to the tongues.

Furthermore, these incisions are preferably implemented in such a manner that they are not arranged above the coolant passages, but rather between them. In the event of any cracks being formed, the risk of further cracking into the coolant passages can be reduced in this way.

In order not to adversely affect the load-bearing capacity of the tongues—which usually run horizontally—it is preferable for the segmenting of the tongues to be implemented in such a way that the individual segments are horizontally offset from one another.

Various further embodiments relate to the detailed design of the holding pipe, securing element and coolant pipe section.

In principle, it is preferably for a holding pipe to in each case surround a coolant pipe section, i.e. for a holding pipe to be led to the outside through the furnace casing, and for a coolant pipe section in each case to be led to the outside through the furnace casing inside a holding pipe.

The nature of the connection between holding pipe and cooling plate or between coolant pipe section and cooling plate or even between holding pipe and coolant pipe section may be of varying design.

According to a first and preferred variant, a disk-like connecting piece is welded to the holding pipe which surrounds the coolant pipe section, and this connecting piece is screwed to the cooling plate. The coolant pipe section is welded to the cooling plate.

According to a second variant, the holding pipe which surrounds the coolant pipe section is directly welded to the cooling plate, and the coolant pipe section is also welded to the cooling plate.

According to a further variant, a connecting piece in the form of a disk or ring is introduced between the coolant pipe section and the holding pipe. The coolant pipe section and the holding pipe are seated on this connecting piece. The connection between the connecting piece and the cooling plate, on the one hand, and between the connecting piece and the coolant pipe section or the holding pipe, on the other hand, is preferably effected by welding.

According to a further variant, the coolant pipe section is designed as a single part and is provided with a flange, which flange is secured to the cooling plate. In this case, the holding pipe surrounds the coolant pipe section, is seated on this flange and is secured to it by welding.

According to a further variant, a holding pipe is also designed as a coolant pipe section, in which case both functionalities, i.e. the supply and removal of coolant and the holding function, are performed by this one pipe section.

With the exception of the last variant described, in all embodiments the coolant pipe sections may be made either from the same base material as the cooling plate or from a different material, preferably the material of the holding pipe.

For the last variant described, this range of choices does not exist, since in this case the coolant pipe is simultaneously also the holding pipe and therefore must in any case be made from the material of the holding pipe.

BRIEF DESCRIPTION OF THE DRAWINGS

The invention is explained in more detail below in the drawings presented in FIG. 1 to FIG. 9.

DESCRIPTION OF PREFERRED EMBODIMENTS

Figure 1A:
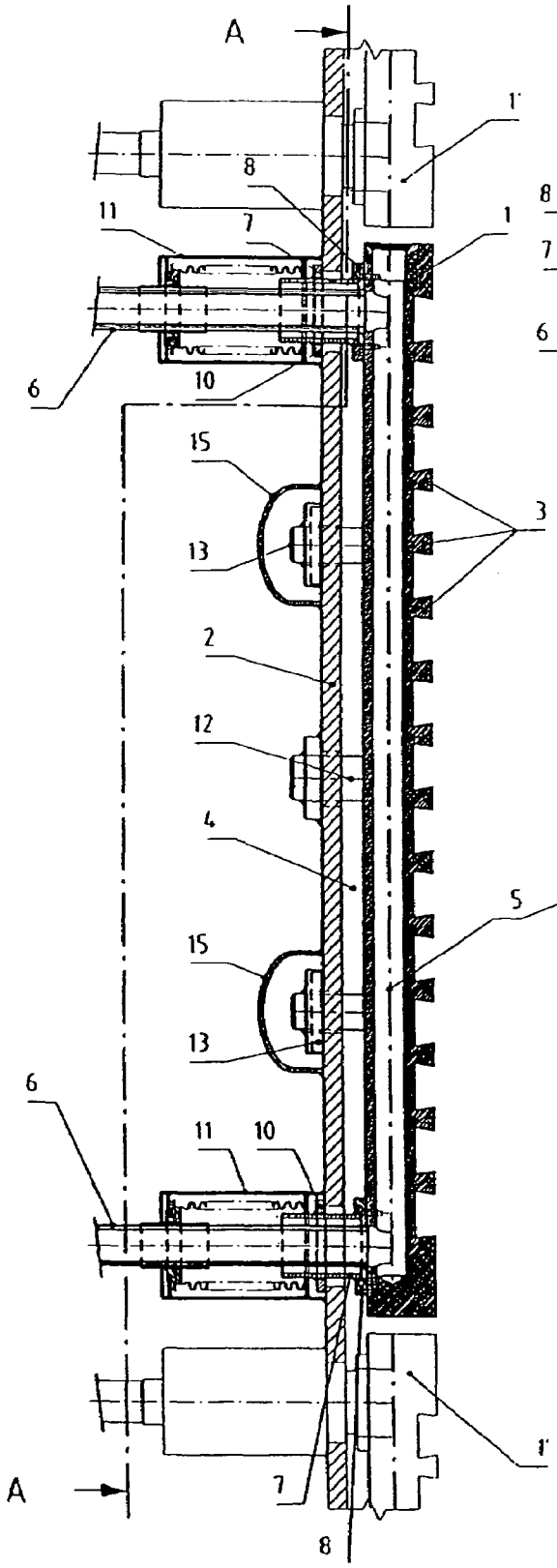
FIG. 1*a* shows an elevational section through a two-passage cooling plate.
Figure 1B:
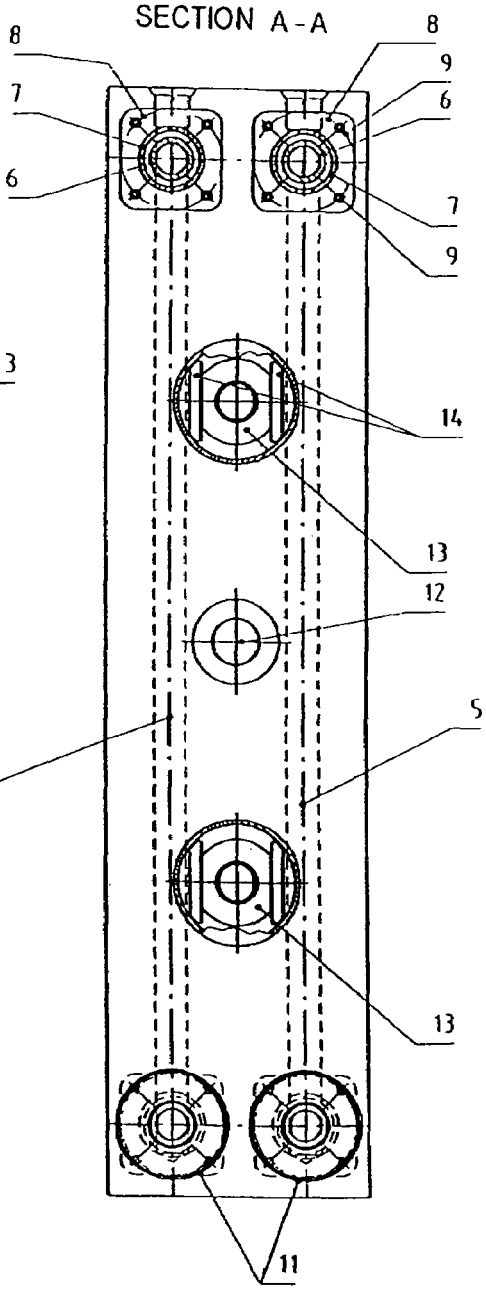
FIG. 1*b* is a view of the cooling plate FIG. 1*a* on the path A-A of FIG. 1*a*.

FIGS. 1*a* and 1*b* shows a two-passage cooling plate 1 which is secured to a furnace casing plate 2. The cooling plate consists of copper and has tongues 3 on the side facing the interior of the furnace. The space between cooling plate 1 and furnace casing plate 2 is backfilled with refractory material 4. Further cooling plates 1' are arranged above and below and—not shown—to the sides of the cooling plate 1. The cooling plate 1 is provided with vertically running cooling passages 5, which are designed as blind bores in the cast or rolled plate body. Coolant pipe sections 6 for supplying and removing coolant (usually water) are led through the furnace casing 2 at the upper and lower ends of each cooling passage 5. At each coolant pipe section 6, a holding pipe 7—surrounding the coolant pipe section 6—is likewise led to the outside through the furnace casing. The holding pipe 7 is screwed to a disk-like connecting piece 8, which for its part is secured to the cooling plate 1 by screw connection 9. Outside the furnace casing 2, the holding pipe 7 is provided with a welded-on holding disk 10 which limits the mobility of the cooling plate 1 in the direction of the interior of the furnace. Holding pipe 7 and coolant pipe section 6 are connected in a gastight manner to the furnace casing plate 2 by means of a standard compensator 11. In the center of the cooling plate 1, the latter is fixedly connected to the furnace casing plate 2 by means of a fixed-point securing element 12 designed as a securing bolt.

The fixed-point securing element 12 is welded in a gastight manner to the furnace casing plate 2. Movable-point securing elements 13 are arranged above and below the fixed-point securing elements 12. The movable-point securing elements 13 are likewise designed as securing bolts, but are not welded in a gastight manner to the furnace casing plate 2, but rather each can slide up and down in a respective guide 14. To provide a seal with respect to the interior of the furnace, sealing hoods 15 are arranged over the movable-point securing elements 13.

Figure 2A:
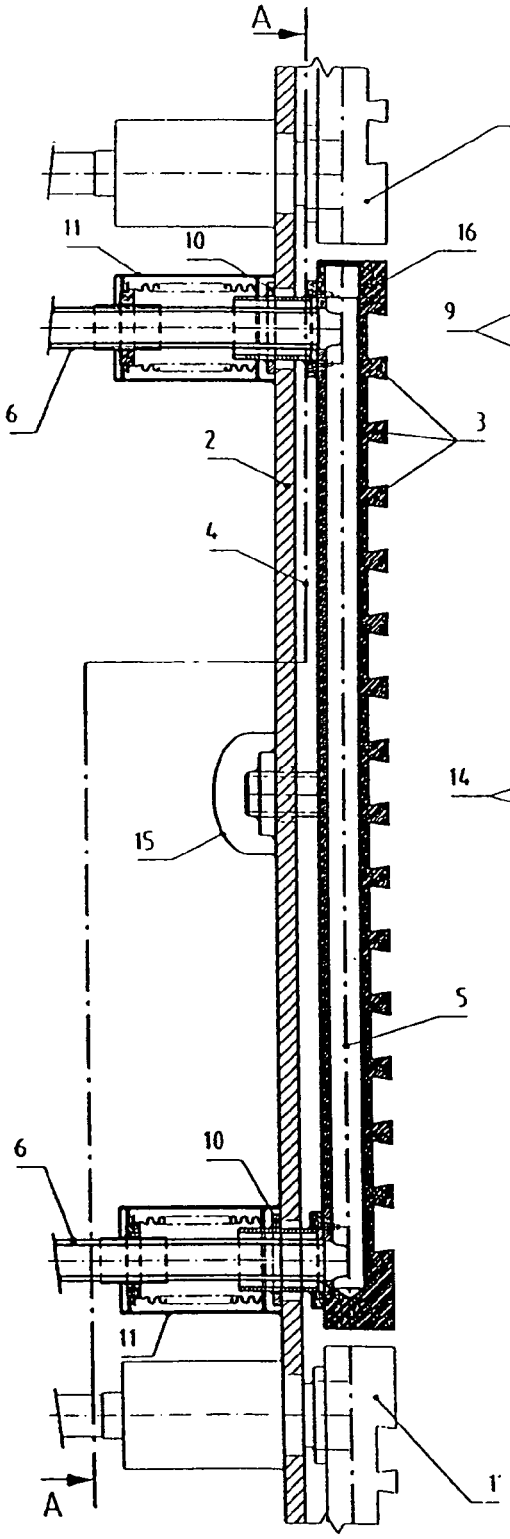
FIG. 2 shows an elevational section through a four-passage cooling plate.
FIG. 2*b* is a view of the cooling plate of the path A-A of FIG. 2*a*.
Figure 2B:
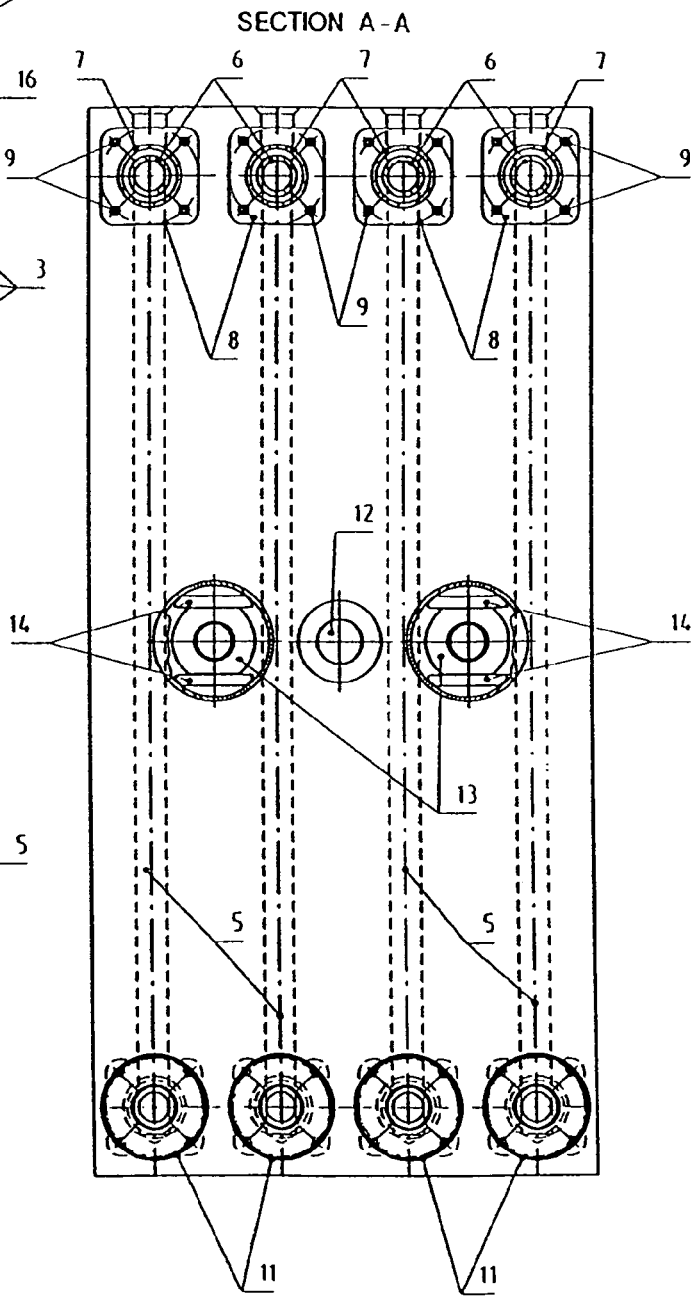

FIGS. 2*a* and 2*b* show a four-passage cooling plate 16 which, apart from having twice the number of cooling passages 5, is substantially identical to the cooling plate 1 illustrated in FIG. 1. On account of the different height/width ratio, however, the movable-point securing elements 13 are not arranged above and below the fixed-point securing element 12, but rather are in each case arranged laterally with respect to the latter. The respective guides 14 for the movable-point securing elements 13 are arranged in such a way that the elements 13 can slide in the horizontal direction.

Figure 3:
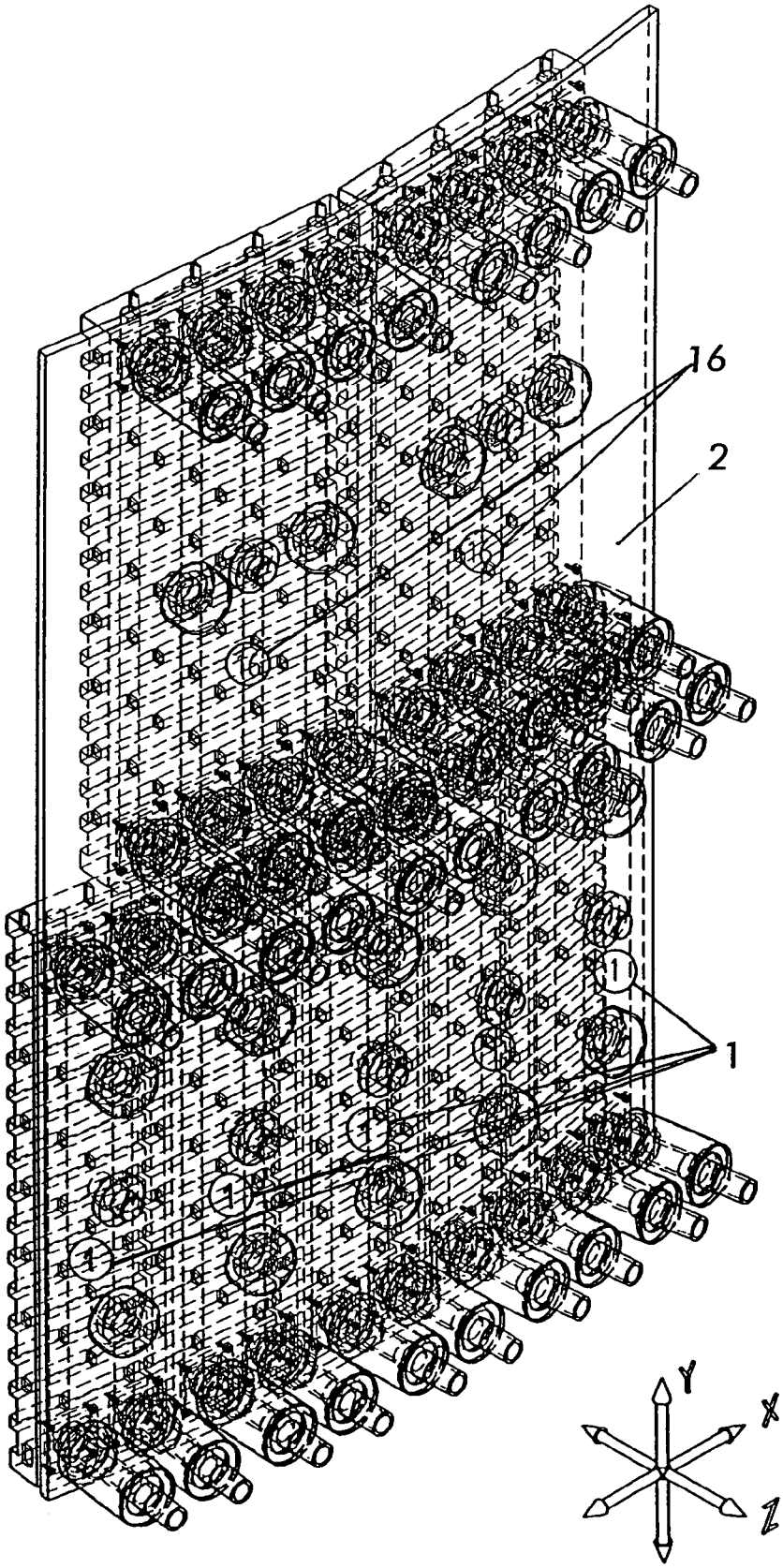
FIG. 3 shows an arrangement of a plurality of cooling plates.

FIG. 3 diagrammatically depicts the arrangement of two-passage cooling plates 1 and four-passage cooling plates 16 in a furnace. The figure also illustrates the system of coordinates which indicates the x, y and z directions to which the text has repeatedly referred.

Figure 4:
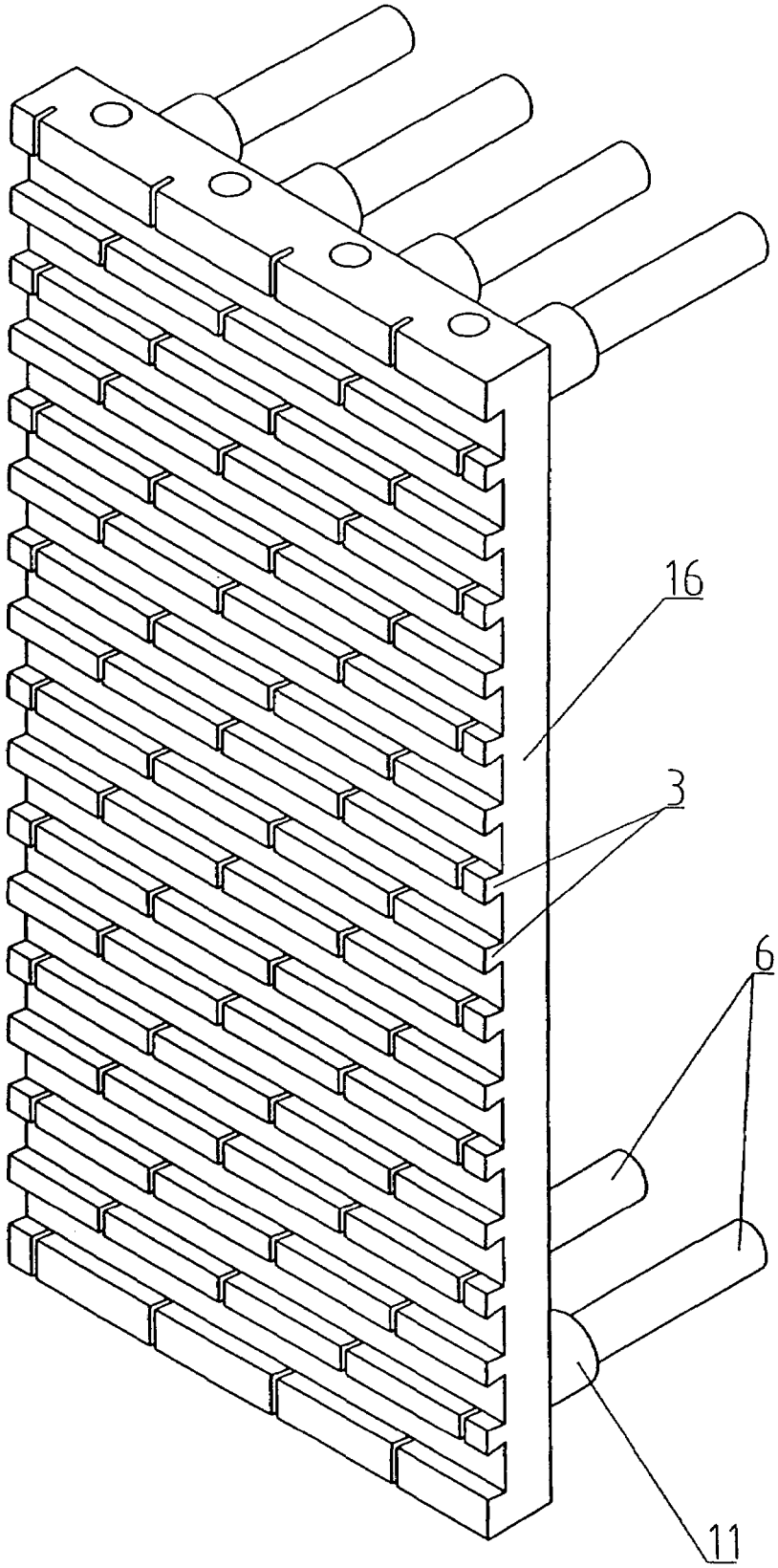
FIG. 4 shows the segmenting of a four-passage cooling plate.

FIG. 4 shows the tongues 3 of the cooling plate 16 which are segmented in the horizontal direction. The individual segments are in each case of approximately identical length and are horizontally offset by approximately half their length.

Figure 5:
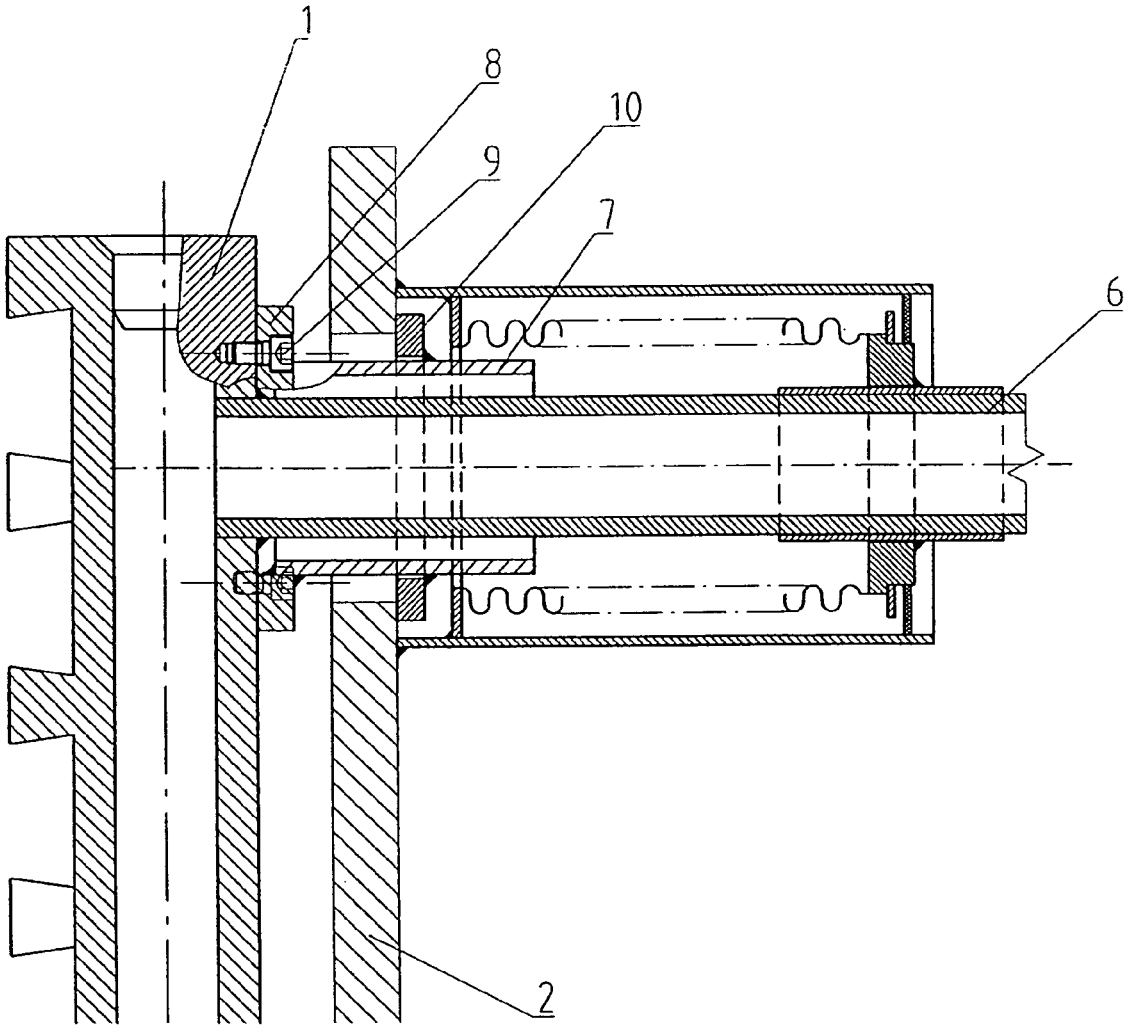
FIG. 5-9 show various designs of a holding pipe.

FIG. 5 shows an enlarged illustration of the preferred variant of the design of holding pipe 7, coolant pipe section 6 in accordance with the invention and also the way in which the connecting piece 8 is secured to the cooling plate 1 by means of screw connection 9. The holding pipe 7 and pipe section 6 are sized to provide a clearance between them.

Figure 6:
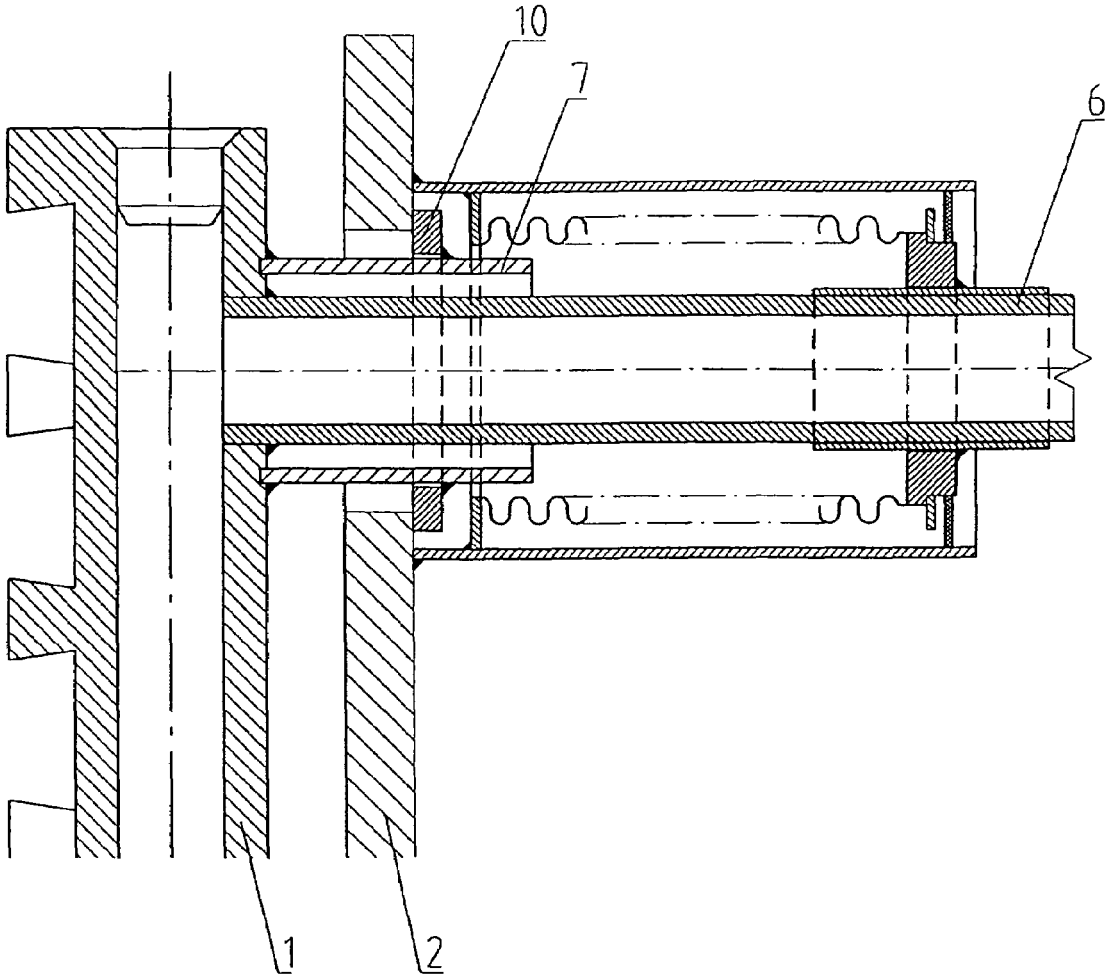

The design shown in FIG. 6 differs from that shown in FIG. 5 in that the connection between holding pipe 7 and cooling plate 1 is produced by welding.

Figure 7:
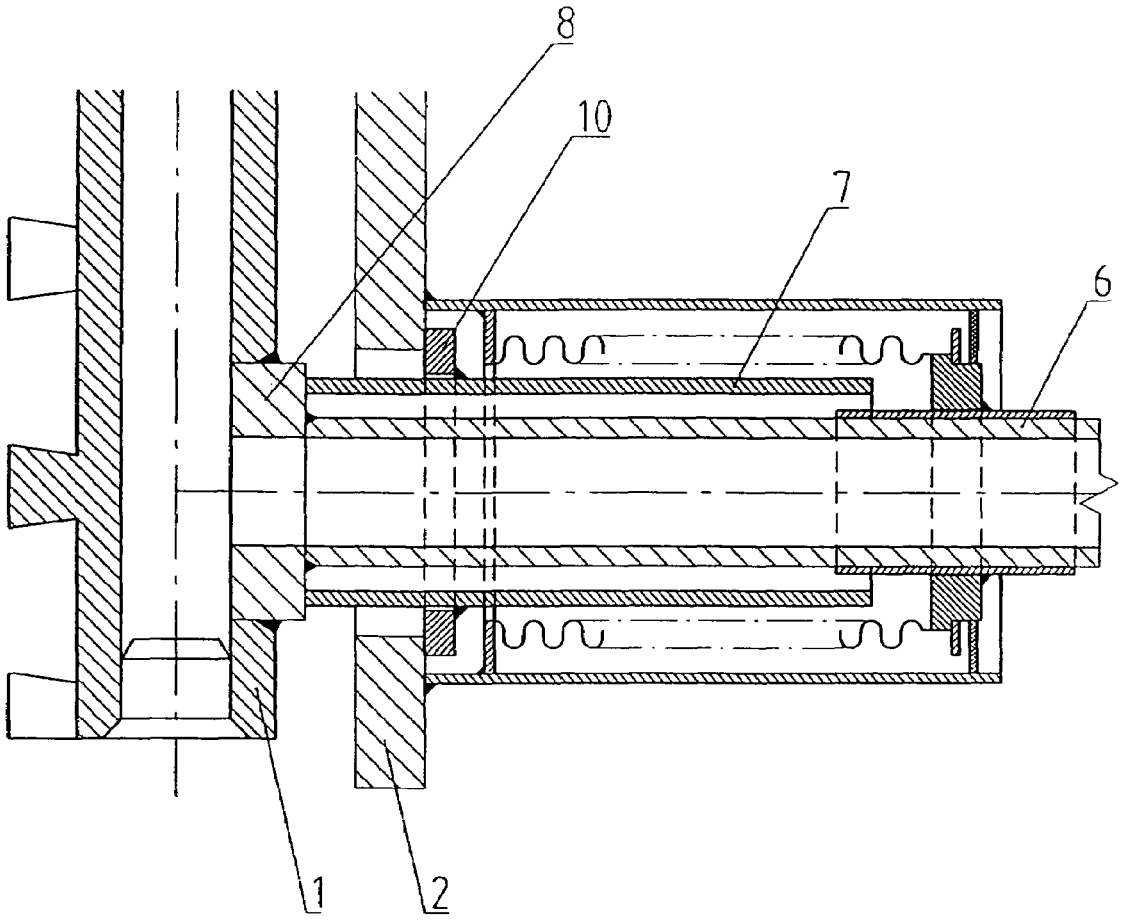

FIG. 7 shows an embodiment in which both the holding pipe 7 and the cooling pipe section 6 are secured to the connecting piece 8.

Figure 8:
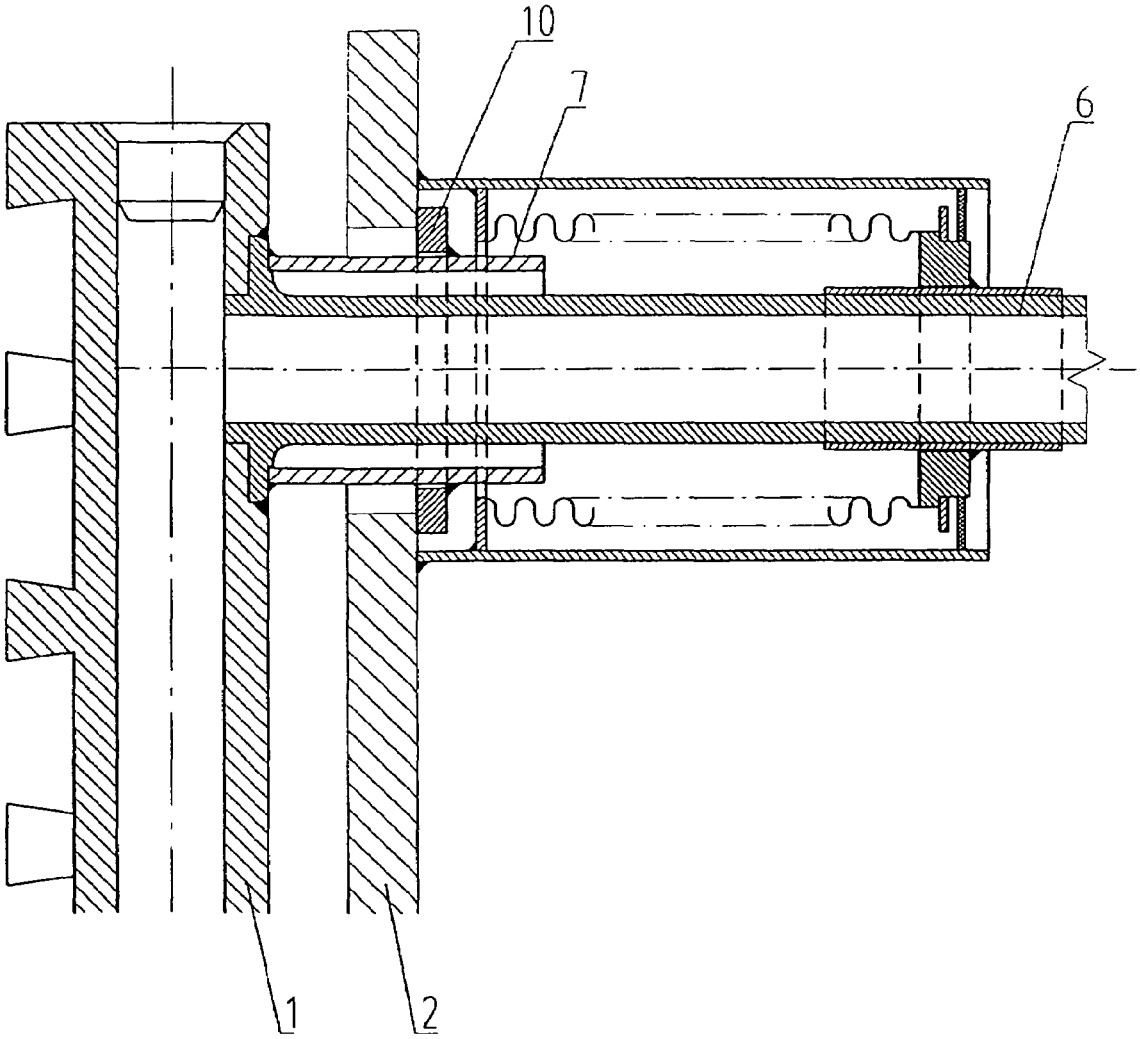

FIG. 8 illustrates a coolant pipe section 6 which is designed as a single part and is provided with a flange, the holding pipe 6 also being secured to this flange.

Figure 9:
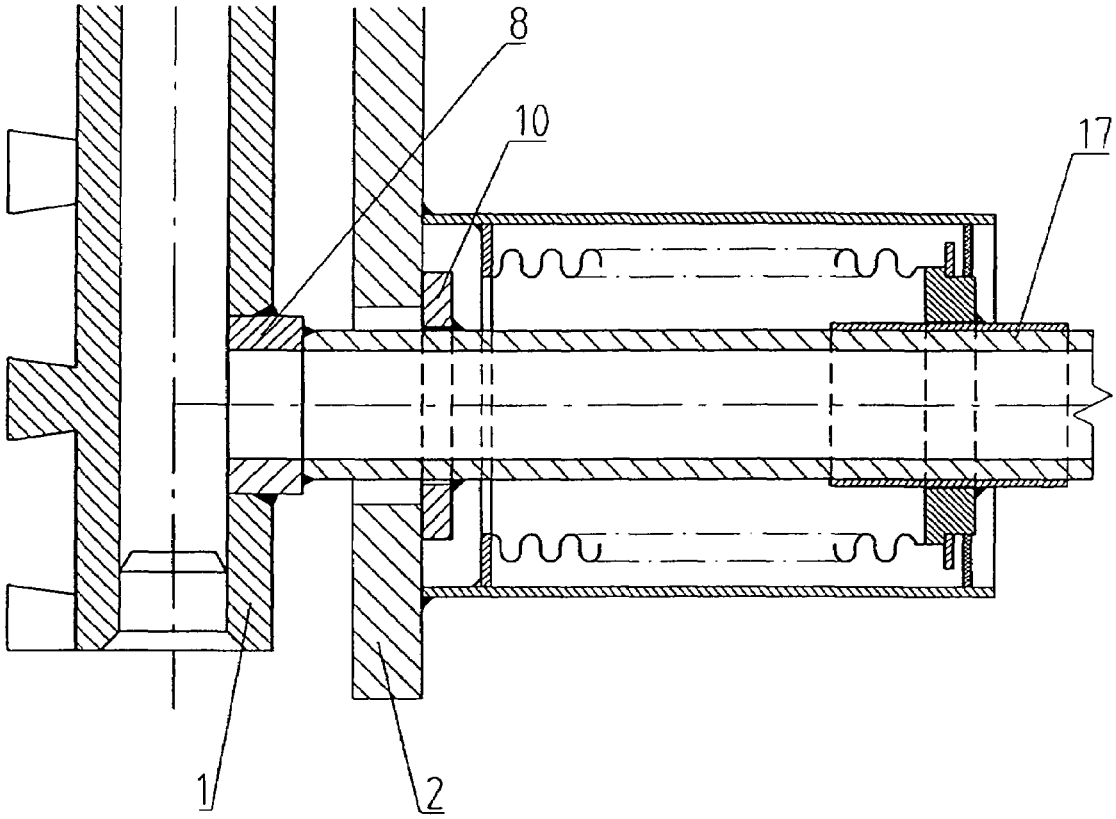

FIG. 9 shows a special embodiment. On an annular connecting piece 8 which is welded to the cooling plate 1 there is fitted a pipe section 17 which is welded to the connecting piece 8, the pipe section 17 being made from the same material as the holding pipes, i.e. for example steel, and, on account of the higher strength compared to copper, simultaneously serving as both the coolant pipe section and the holding pipe.

In all the drawings represented in FIG. 5 to 9, holding disks 10, which are arranged directly outside the furnace casing 2 and are welded to the holding pipes 7, 17, fix the corresponding cooling plate 1 in the z direction with respect to the furnace interior.

The invention claimed is:

1. A metallurgical furnace comprising:

an outer casing plate defining a casing of the metallurgical furnace and having an outside surface facing away from an inside of the metallurgical furnace;

a cooling plate comprised of copper or a low-alloy copper alloy provided inward of the outer casing plate;

a fixed-point securing element securing the cooling plate to the outer casing plate at a central region of the cooling plate;

at least one coolant passage running inside the cooling plate;

coolant pipe sections connected with the at least one coolant passage for enabling coolant to flow respectively in and out of the coolant passages, the coolant pipe sections leading to outside of the furnace cooling plate through the outer casing plate;

the cooling plate comprising holding pipes thereon leading to the outside through the outer casing plate;

second securing elements supported against the outside surface of the outer casing plate to allow movement of the cooling plate in both a vertical direction and a horizontal direction and to prevent movement of the cooling plate in a direction inward with respect to the furnace, the second securing elements securing the holding pipes;

the holding pipes and the securing elements being comprised of a material with a greater strength than the copper or low-alloy copper alloy of the cooling plate; and each coolant pipe section of the coolant pipe sections being led to the outside of the outer casing plate inside a respective holding pipe of the holding pipes and each coolant pipe section and the respective holding pipe section are sized to provide a clearance between them.

2. The furnace as claimed in claim 1, wherein the cooling plate has a height/width ratio of $\geqq 3$;

the furnace further comprising at least one movable-point securing element arranged at least one of above and below the fixed-point securing element, and the movable-point securing element is operable to allow mobility of the cooling plate only in the vertical direction.

3. The furnace as claimed in claim 1, wherein the cooling plate has a height/width ratio of $<3$;

the furnace further comprising at least one moveable-point securing element arranged to at least one of the left and the right of the fixed-point securing element, and the movable-point securing element is operable to allow mobility of the cooling plate only in the horizontal direction.

4. The furnace of claim 3, wherein the cooling plate has a height/width ratio of $<2$.

5. The furnace as claimed in claim 1, wherein the cooling plate has tongues and grooves on a side thereof which faces the interior of the furnace, and the tongues are segmented in a longitudinal direction of the tongues.

6. The furnace as claimed in claim 1, further comprising a connecting piece provided between the holding pipe and the respective coolant pipe section.

7. The furnace of claim 6, wherein the connecting piece is in the form of a ring or a disk.

8. The furnace as claimed in claim 1, further comprising a coolant pipe section formed as a single part and including a flange secured to the cooling plate.

9. The furnace as claimed in claim 8, wherein each holding pipe surrounds the coolant pipe section and is secured to the flange.

10. The furnace as claimed in claim 1, wherein the pipe sections for coolant to flow in and out are made from the same material as the cooling plate.

11. The furnace as claimed in claim 1, wherein the pipe section is both a holding pipe and a coolant pipe section.

12. The furnace as claimed in claim 1, wherein the pipe sections for coolant to flow in and out are made from the same material as the holding pipes.

13. The furnace of claim 1, wherein at least two of the coolant passages run inside the cooling plate.

14. The furnace of claim 1, wherein the securing elements are applied to the holding pipes after the holding pipes have passed through the outer casing plate to the outside.

15. The furnace of claim 1, wherein the securing elements securing the holding pipes comprise holding plates or holding disks.

16. The furnace of claim 1, wherein the fixed-point securing element secures the cooling plate to the outer casing plate in a central region of the cooling plate.

17. The furnace of claim 1, wherein the holding pipe is secured directly to the cooling plate.

18. The furnace of claim 17, wherein the securement of the holding pipes to the cooling plate is by screwing or welding.

19. The furnace of claim 1, further comprising at least one movable-point securing element arranged at least one of above and below the fixed-point securing element, and the movable-point securing element is operable to allow mobility of the cooling plate only in the vertical direction.

20. The furnace of claim 1, further comprising at least one moveable-point securing element arranged to at least one of the left and the right of the fixed-point securing element, and the movable-point securing element is operable to allow mobility of the cooling plate only in the horizontal direction.

21. A cooling plate for use in a metallurgical furnace having an outer furnace casing plate with an inside and an outside, the cooling plate comprising:

a plate positioned on the inside of the outer furnace casing plate and comprising copper or a low-alloy copper alloy;

a fixed-point securing element securing the cooling plate to the outer furnace casing plate at a central region of the cooling plate;

at least one coolant passage running inside the cooling plate;

coolant pipe sections connected with the at least one coolant passage for enabling coolant to flow respectively in and out of the coolant passages, the coolant pipe sections leading to outside of the furnace casing plate through the outer furnace casing plate;

the cooling plate having holding pipes thereon leading to the outside;

second securing elements supported against the outside of the outer furnace casing plate to allow movement of the cooling plate in both a vertical direction and a horizontal direction and to prevent movement of the cooling plate in a direction inward with respect to the metallurgical furnace, the second securing elements securing the holding pipes;

securing elements comprised of a material with a higher strength than the copper or low-alloy copper alloy of the cooling plate, the securing elements and the holding pipes being configured to secure the cooling plate to the outer furnace casing plate; and each coolant pipe section of the coolant pipe sections being led to the outside of the outer furnace casing plate inside a respective holding pipe of the holding pipes and each coolant pipe section and the respective holding pipe section are sized to provide a clearance between them.

22. The cooling plate of claim 21, wherein the cooling plate has a height/width ratio of $\geqq 3$;

the cooling plate further comprising at least one movable-point securing element arranged at least one of above and below the fixed-point securing element, and the movable-point securing element is operable to allow mobility of the cooling plate only in the vertical direction.

23. The cooling plate of claim 21, further comprising at least one movable-point securing element arranged at least one of above and below the fixed-point securing element, and the movable-point securing element is operable to allow mobility of the cooling plate only in the vertical direction.

24. The cooling plate of claim 21, wherein the cooling plate has a height/width ratio of $<3$;

the cooling plate further comprising at least one moveable-point securing element arranged to at least one of the left and the right of the fixed-point securing element, and the movable-point securing element is operable to allow mobility of the cooling plate only in the horizontal direction.

25. The cooling plate of claim 21, further comprising at least one moveable-point securing element arranged to at least one of the left and the right of the fixed-point securing element, and the movable-point securing element is operable to allow mobility of the cooling plate only in the horizontal direction.

* * * * *